US008770625B1

(12) United States Patent
Beretta

(10) Patent No.: US 8,770,625 B1
(45) Date of Patent: Jul. 8, 2014

(54) ANTI-COUNTERFEITING ARTICLES

(75) Inventor: Giordano Bruno Beretta, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1886 days.

(21) Appl. No.: 11/615,299

(22) Filed: Dec. 22, 2006

(51) Int. Cl.
*B42D 15/00* (2006.01)

(52) U.S. Cl.
USPC ..... 283/70; 283/114

(58) Field of Classification Search
None
See application file for complete search history.

(56) References Cited

U.S. PATENT DOCUMENTS

| | | | | |
|---|---|---|---|---|
| 2004/0013285 | A1* | 1/2004 | Jordan et al. | 382/100 |
| 2007/0158434 | A1* | 7/2007 | Fan | 235/487 |
| 2008/0093468 | A1* | 4/2008 | Fan et al. | 235/494 |

OTHER PUBLICATIONS

Michael A. Webster et al. Color contrast and contextual influences on color appearance. Journal of Vision ISSN 1534-7362, pp. 505-519 (2002).
Michael A. Webster, "Light adaptation, contrast adaptation, and human color vision," in Colour Perception—mind and the physical world, Rainer Mausfeld and Dieter Heyer Eds., O.
Brian A. Wandell, Foundations of vision science, Sinauer Associates, Inc., 1995, pp. 212-216.
Smith et al., "Chromatic Contrast Discrimination: Data and Prediction for Stimuli Varying in L and M Cone Excitation," Color Research & Application, vol. 25, No. 2, Apr. 2000.
MacLeod et al., "Chromaticity diagram showing cone excitation by stimuli of equal luminance," J.Opt.Sci.Am., vol. 69, No. 8, Aug. 1979, pp. 1183-1186.

* cited by examiner

*Primary Examiner* — Kyle Grabowski

(57) ABSTRACT

An object is protected against counterfeiting by an article including an HVS-perceivable target and HVS-perceivable texture surrounding the target. The texture produces a gentle HVS stimulus modulation. Color of the target has a higher saliency than that of the texture, whereby the texture provides camouflage for the target. Location of the target with respect to the texture is a function of a serial number or other information about the object.

3 Claims, 4 Drawing Sheets

ANTI-COUNTERFEITING ARTICLES

BACKGROUND

Counterfeiting poses a serious problem for the pharmaceutical, cosmetics, electronics, software, automotive and aircraft industries, to name a few. Counterfeit products can lead to lost revenues, increased liability, and brand erosion. Product recalls due to counterfeit warnings are expensive and disruptive.

Crude counterfeiters typically use offset presses to print packages and labels for counterfeit products. Although counterfeiting is cheap, all packages appear the same.

Such crude counterfeiting can be thwarted by adding unique features to the packages. For example, serial numbers can be printed or embossed on the packages.

Other anti-counterfeiting measures can be taken. Anti-counterfeiting measures intended for detection by end-users include marking products with holograms. Anti-counterfeiting measures intended for forensic analysts include marking products with micro-displacement of glyphs. Anti-counterfeiting measures intended for trained inspectors include marking products with fluorescent inks. However, these other anti-counterfeiting measures add complexity or cost (or both) to product packaging.

For trained inspectors, certain situations require quick, unobtrusive detection. An inspector might have to enter a store and determine whether the products being sold are counterfeit. If the inspector draws attention, his life could be at risk.

Marking goods with serial numbers and fluorescent inks do not facilitate quick, unobtrusive detection.

A quick, unobtrusive anti-counterfeiting measure intended for trained inspectors would be desirable. A simple and inexpensive implementation of such a method would also be desirable.

SUMMARY

According to one aspect of the present invention, an object is protected against counterfeiting by an article including an HVS-perceivable target and HVS-perceivable texture surrounding the target. The texture produces a gentle HVS stimulus modulation. Color of the target has higher saliency than that of the texture, whereby the texture provides camouflage for the target. Location of the target with respect to the texture is a function of a serial number or other information about the object.

Other aspects and advantages of the present invention will become apparent from the following detailed description, taken in conjunction with the accompanying drawings, illustrating by way of example the principles of the present invention.

DETAILED DESCRIPTION

Figure 1:
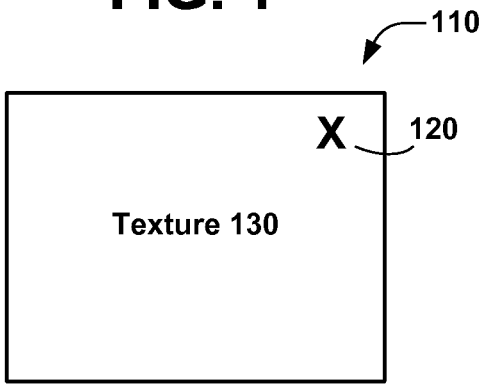
FIG. 1 is an illustration of an article in accordance with an embodiment of the present invention.

Reference is made to FIG. 1, which illustrates an anti-counterfeiting article 110. The article 110 includes a target 120 and texture 130 surrounding the target 120. Both the target 120 and the texture 130 are perceivable by the human visual system (HVS).

The texture 130 produces a gentle HVS stimulus spatial modulation. A stimulus spatial modulation refers to a stimulus that is not constant (i.e., the texture area is not in a solid color) but depends on the relative location of elements that make up the texture. A spatially modulated stimulus is considered "complex". "Gentle" means that the modulation has a low amplitude or spatial frequency or both. An example of such texture is described below in connection with FIG. 4. Another example of such texture is described in Michael A. Webster et al. "Color contrast and contextual influences on color appearance. Journal of Vision ISSN 1534-7362, pp. 505-519 (2002). For a more detailed explanation with respect to natural images, see Michael A. Webster, "Light adaptation, contrast adaptation, and human color vision," in Colour Perception—mind and the physical world, Rainer Mausfeld and Dieter Heyer Eds., Oxford University Press, 2003. For adaptation to patterns see Brian A. Wandell, Foundations of vision science, Sinauer Associates, Inc., 1995, pp. 212-216. For a discussion of chromatic contrast discrimination see Vivianne C. Smith et al., "Chromatic Contrast Discrimination: Data and Prediction for Stimuli Varying in L and M Cone Excitation," Color Research and Application, Vol. 25, No. 2, April 2000, pp. 105-115.

The colors are selected so the target 120 has higher saliency than the texture 130. The texture 130 provides camouflage for the target 120. If saliency of the target 120 is at or near a visual threshold, the target 120 will not be easily noticeable. A person looking at the texture 130 will notice the target 120 only if he or she is already aware of the target 120.

Figure 6A:
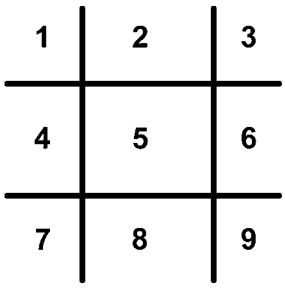
FIGS. 6*a*-6*b* are illustrations of an encoding scheme for the article of FIG. 3.

Location of the target 120 with respect to the texture 130 is a function of information about the object being protected against counterfeiting. For example, the information may be a serial number of the object. An exemplary encoding scheme will be discussed below in connection with FIGS. 6*a*-6*b*.

The information about the object is not limited to serial numbers. For example, the final destination country or a distribution channel can be encoded, so that product diversions can be discovered without having to look up a serial number in a large directory.

An article according to some embodiments of the present invention may include only the target 120 and the texture 130. In other embodiments, the articles may include not only the target 120 and texture 130, but also graphics, product info (e.g., serial number, shipping code, product part, UPC, lot number), etc.

In still other embodiments, an article may include the target 120 and texture 130, as well as the medium upon which the target 120 and texture 130 are placed. Examples of the medium include, without limitation, the object itself, a package, box, crate, shipping container, pallet, substrate, wrapper, label, test strip, or package insert for the object.

The object is not limited to anything in particular. An object could be a pharmaceutical or cosmetic product, an electronics component, software, an automotive or aircraft part, etc.

The texture should be reproduced predictably. This will allow inspectors to be trained on the texture so, when they are in the field, the texture appears as learned. In addition, the target's perceived hue should robust with respect to printing variances.

Figure 2:
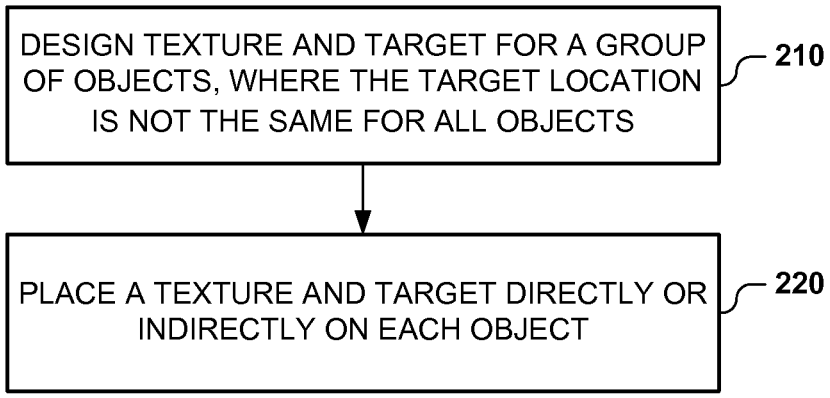
FIG. 2 is an illustration of a counterfeit protection method in accordance with an embodiment of the present invention.

Reference is now made to FIG. 2, which illustrates an anti-counterfeiting protection method. Texture and a target are designed for a group of objects (block 210). The texture may be the same or slightly different for all of the objects, but the locations of the targets on the objects are not all the same. The texture and targets are placed directly or indirectly (e.g., on a package, label, etc.) on the objects (block 220)

Figure 3:
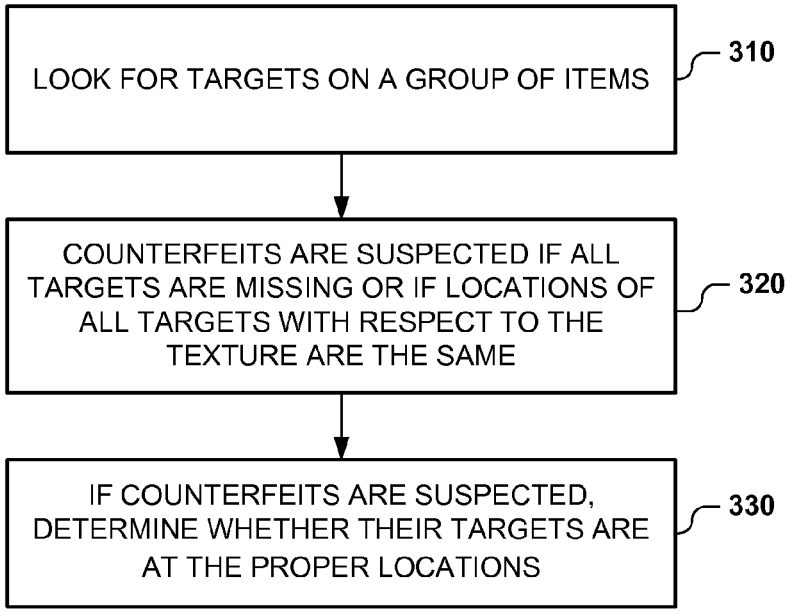
FIG. 3 is an illustration of a counterfeit detection method in accordance with an embodiment of the present invention.

Reference is now made to FIG. 3, which illustrates a counterfeit detection method. Targets surrounded by texture are looked for on a group of items (block 310). Counterfeits are suspected if the targets are missing on all items or if all targets have the same locations with respect to the texture (block 320). Thus, counterfeit detection can be performed from afar.

More accurate counterfeit detection may be performed if counterfeiting is suspected. For example, the information (e.g., serial numbers) about the objects can be used to determine whether their targets are at the proper locations on all of the items (block 330).

An article with the target and texture offers inexpensive protection against crude counterfeiting of objects. It also allows inspectors to perform quick, unobtrusive counterfeit detection.

Figure 4:
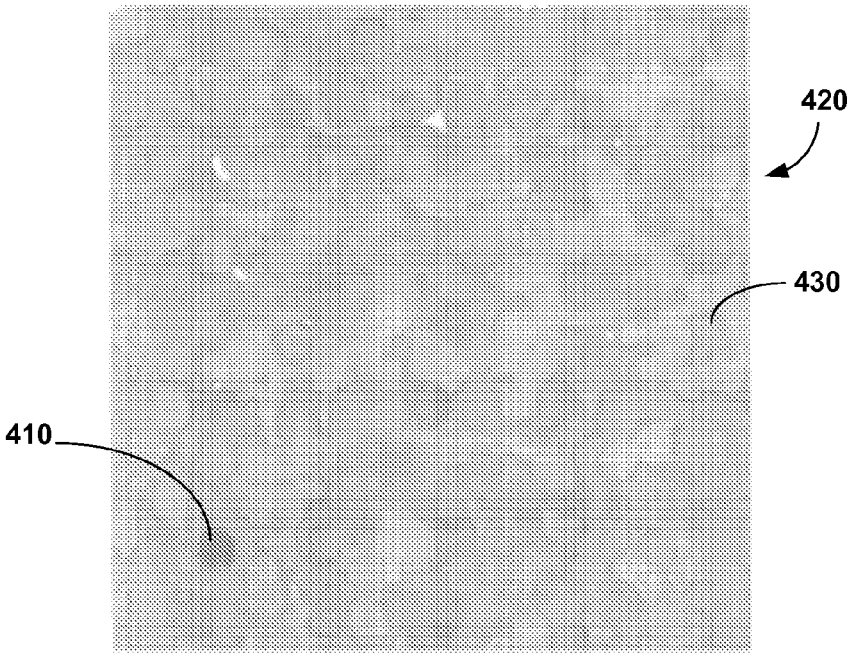
FIG. 4 is an illustration of an article in accordance with an embodiment of the present invention.

Reference is now made to FIG. 4, which illustrates an exemplary target 410 and texture 420. The texture 420 and target 410 are formed by a repetition of a basic element 430. FIG. 4 shows the basic element 430 as a blob. In other embodiments, however, the basic element 430 could be a geometric shape (e.g., a circle), or a logo, symbol, crest, pictogram or other suitable shape. Location of each of the basic elements 430 is pseudorandom. Location of the target 410 is determined from information about the object, and the basic element 430 at that location is designated as the target 410. The remaining basic elements 430 are collectively designated as the texture 420. Initial coverage of the texture 420 may be 100% or some other predetermined percentage. The coverage may be adjusted.

Figure 5:
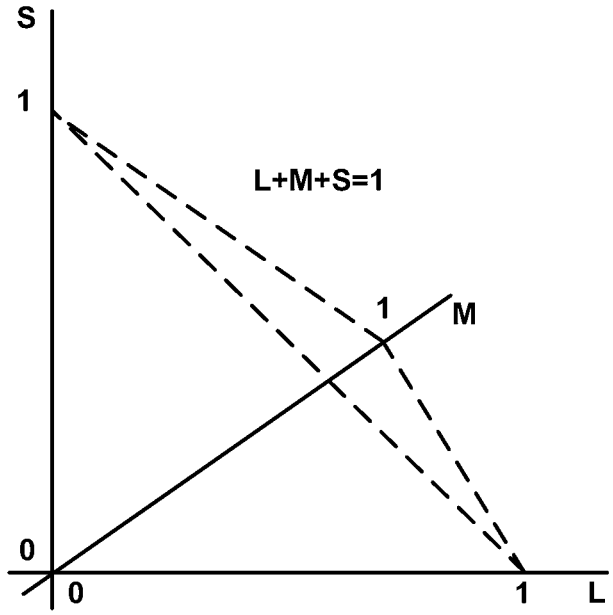
FIG. 5 is an illustration of cone space.

Additional reference is made to FIG. 5, which illustrates cone space and a chromaticity triangle. The origin (0, 0, 0) of the coordinate system is where M, L, and S cones have the same null stimulation (i.e., black). Colors for the texture lie along an L-M axis of the cone space. The color of the target lies on the S-axis, which is orthogonal to the L-M axis. An L-M axis is a straight line that lies in a plane parallel to the plane spanned by L and M axes, and extends through the S axis. A straight line may be selected from the many possible choices so that it works well with the overall color design of the texture and target.

A color representation with a high degree of opponency is used. Of the many available representations cone space may be used because perceptual data for it is readily available. As will be seen later, another representation is Munsell space, for which perceptual data is readily available in the Munsell Book of Colors. Other colorimetric color spaces such as CIELAB, etc., may be used.

A gentle color contrast modulation of the texture 420 can be created by picking multiple colors that stimulate long wavelength sensitive L cones and medium wavelength sensitive M cones of the human visual system so that only the ratios of the stimuli affecting the L and the M cones is varied, while short wavelength S cone stimulation is kept constant. Robust colors for the target 410 can be found by varying the stimulation of short wavelength sensitive S cones of the human visual system while the sum of the L and M cone stimulations is kept constant.

Webster's experimental data suggests that the stimulation by the texture 420 can be varied along a different axis, namely a segment of a hue axis. For example, the target 410 may have the same Munsell value and chroma as the texture 420, but hue of the target 410 may be a complement of the average (or other statistical measure) of hue of the texture 420. The texture 420 may have multiple colors having the same Munsell value and chroma but equally spaced apart hues, thereby producing modulation from a color contrast without a luminance contrast and therefore a more gentle modulation for camouflaging the hue. The colors may be randomly assigned to the basic elements 430 that make up the texture 420.

As another example, the texture 420 can be varied along a segment of a chroma axis and the target 410 may have the same Munsell value and hue as the texture 420. However, the Munsell chroma of the target 410 may be outside the texture's chroma segment.

The texture 420 and target 410 in FIG. 4 are shown in different shades of gray in order to satisfy U.S. Patent Office procedure (which discourages the use of color drawings). The different shades of gray are intended to represent different hues. Thus, FIG. 4 is intended to represent a target 410 and texture 420 having the same Munsell value and chroma, but different hues.

Figure 6B:
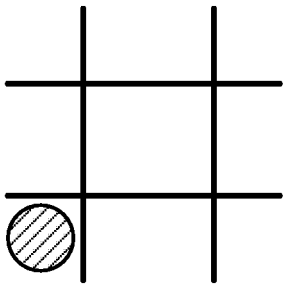

Reference is now made to FIGS. **6*a*-6*b*, which illustrate an exemplary encoding scheme for determining the location of the target. The encoding scheme makes use of a code, such as a serial number. A digit from the code is taken, and its value is used to select a cell in a 3×3 grid. Cells of the grid correspond to locations with respect to the texture. Using the grid of FIG. 6*a*, a digit having a value of 5 would cause the target to be located in the center of the texture, a value of 7 would cause the target to be located in the lower left corner of the texture (as illustrated in FIGS. 4 and 6*b***), a value of 3 would cause the target to be located in the upper right corner of the texture, and so on. Other indicia can be added to determine the orientation of the texture (e.g., which side is "up").

The specific digit from the serial number can be changed, for example for each lot or each month. An inspector can then look at the target's position and verify that it matches the encoding of the serial number digit for that expiration date or lot number.

Other encoding schemes may be used. For example, another scheme might encode the remainder of integer division of the serial number by an integer. The remainder determines the number of marks on the texture. An inspector can compute the remainder using Pascal's method.

For example, modulo 7 encoding of the remainder could produce one target if the remainder is '1', two targets if the remainder is '2', and so on. A remainder of '7' could produce zero targets. The targets may be arranged similar to dice eyes or some other pattern. Consider the serial number 75342, which can be written in polynomial form as $7\cdot10^4+5\cdot10^3+3\cdot10^2+4\cdot10^1+2\cdot10^0$. The polynomial can be arranged as follows.

| | | | | |
|---|---|---|---|---|
| 7 | 5 | 3 | 4 | 2 |
| $10^4$ | $10^3$ | $10^2$ | $10^1$ | $10^0$ |

The second row is then replaced by the remainders modulo 7 to produce the following:

| | | | | |
|---|---|---|---|---|
| 7 | 5 | 3 | 4 | 2 |
| 4 | 6 | 2 | 3 | 1 |

Finally, each number in the upper row is multiplied by the corresponding number in the lower row and then added as follows: $7\cdot4+5\cdot6+3\cdot2+4\cdot3+2\cdot1=78$. The remainder of 78 modulo 7 is 1. Since the remainder of 78 modulo 7 is 1, also the remainder of 75342 modulo 7 is 1, which is encoded with a single dot in region 5 of FIG. 6*a*.

The encoding is valid for numbers other than 7. An inspector can be trained to perform the encoding as a mental process, without resorting to a calculator or a pad and pencil.

If the basic element is directional, for example a logo, then the target's orientation with respect to the texture can have a specific meaning.

Figure 7:
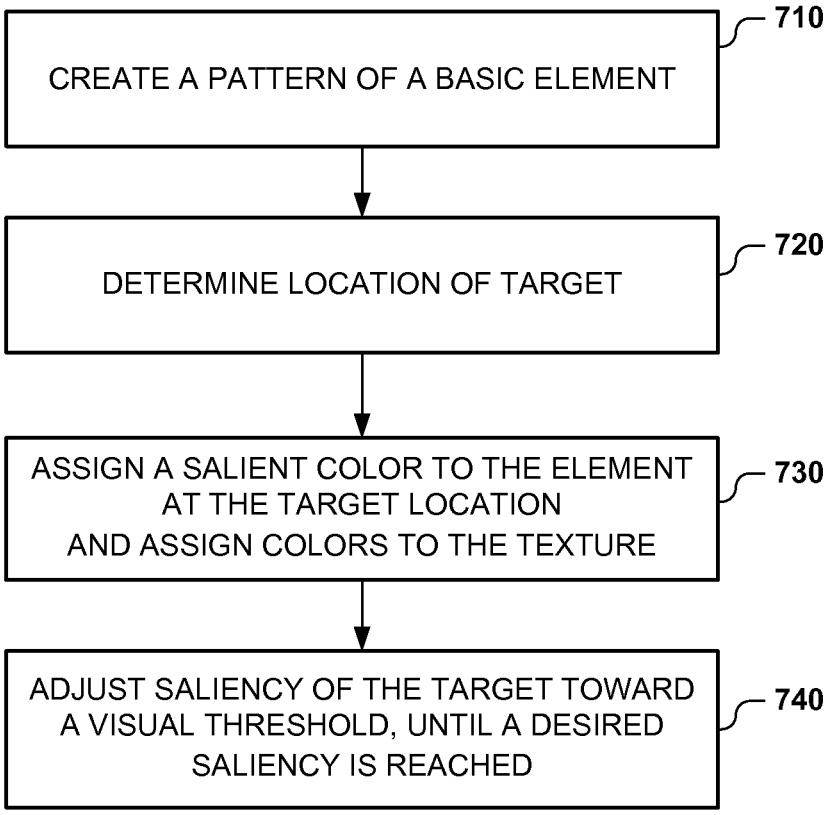
FIG. 7 is an illustration of a method of designing a target and texture in accordance with an embodiment of the present invention.

Reference is now made to FIG. 7, which illustrates a method of designing a texture and a target. A pattern of a basic element is created (block 710). To create the pattern, locations of the basic elements are determined, and a basic element is centered at each location.

The locations of the elements may be selected at random, or the locations may be pseudo-random. Pseudo-random locations may be determined from a serial number of the object. Some or all digits of the serial number may be used as a seed for a pseudo-random number generator, which may be used to determine the locations.

Information about the object is encoded to determine a target location (block 720). A salient color is assigned to the element at the target location, and colors are assigned to the texture. Colors for the texture are found (block 730), for example, by picking multiple colors that stimulate L and M cones of the human visual system so that only the ratios of the stimuli affecting the L and the M cones is varied, while S cone stimulation is kept constant. Color of the target is found (block 730), for example, by varying the stimulation of the S cones of the human visual system while the sum of the L and M cone stimulations is kept constant. The colors for the texture may be taken from the L-M axis in cone space, and an orthogonal color is selected for the target. Alternatively, assigning the colors to the texture may include selecting colors that have the same luminance but equally spaced apart hues. One way of doing this is to select Munsell patches at fixed hue increments. As a result, colors for the texture outside of the region have the same luminance and chroma but equally spaced apart hues Saliency of the target is adjusted toward a visual threshold, until a desired saliency is reached (block 740). The saliency could be adjusted by adjusting the target's chroma. The saliency can also be adjusted by adjusting the texture coverage (e.g., by adding basic elements, increasing element size) and texture colors. If the texture colors are adjusted, the target's hue is changed to the complement of the texture's average hue, so the target's perceived hue is robust with respect to printing variances. As a result of the adjustment, color contrast between the target and texture is smaller and the induced color contrast will be smaller.

A software tool may be used to design the texture and target. The tool may have a GUI with controls (e.g., sliders, text controls) that allow the background coverage and saliency to be adjusted to visually determine thresholds suitable for the tolerances of a particular printing process and the viewing conditions where the inspection takes place. The GUI may provide a text control for entering a serial number or other piece of information about the object being protected. The software tool, in turn, can use that information as a seed for generating a pseudo-random pattern of elements and for selecting the location of the target. In the alternative, the GUI can provide an additional text control that allows the designer to specify a seed. The GUI may also provide a list of color schemes (e.g., palettes of Munsell patches at fixed hue increments) to be selected for the texture. Once the texture colors have been selected, the software tool computes the color for the target. Finally, the GUI may provide a window for displaying the texture and target during the various stages of design (e.g., laying out the basic elements before color has been added, displaying the target and texture while the saliency is being adjusted, etc.). The software tool may be a standalone program or it may be integrated with a larger program (e.g., a graphical editor).

The texture and target may be printed by a digital printing press. A digital printing press offers certain advantages over conventional ink-based printers. A digital printing press can vary its print image on each impression, whereby the target can be printed at different locations with respect to the texture during a single print run.

Figure 8:
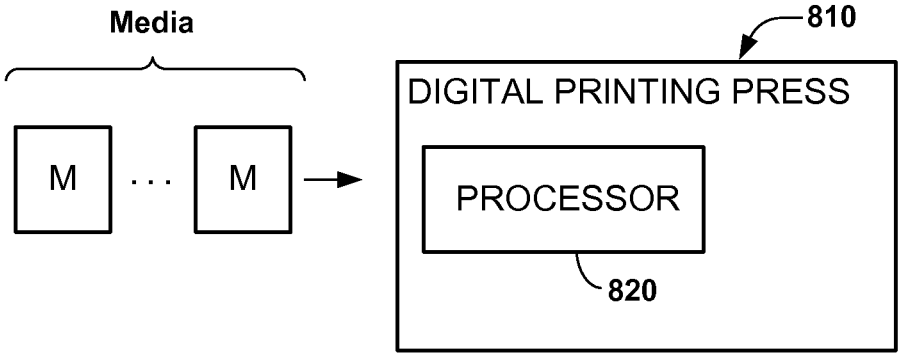
FIG. 8 is an illustration of a digital printing press in accordance with an embodiment of the present invention.

Reference is now made to FIG. 8 which illustrates a digital printing press 810 having a front-end processor (a.k.a. RIP, Raster Image Processor or formatter) 820. The front-end processor 820 can be programmed with a texture and target, and it can be further programmed to determine the number and location of targets, as well as to print the texture and target(s) on media (M) during a print run. The front end processor 820 could even generate the texture, using a different seed for each impression, whereby the texture can be made to differ slightly during a print run. For added security, the front-end processor 820 can be made tamper-proof (e.g., by adding a tamper-proof component that applies the security pattern), A tamper proof processor 820 prevents another party (e.g., a press operator or owner) from changing the processor programming. This, in turn, allows the articles to be traced to a particular press, when, for example, the printing press ends up in the hands of a counterfeiter.

A texture and target in accordance with an embodiment of the present invention may be printed directly or indirectly on the object to be protected. Ink, toner, or other colorants may be used to form the texture and target. However, the texture and target are not limited to printing. For example the texture and target may be silk screened (e.g., on chinaware or tiles), they may be woven (e.g., in a tie or scarf), etc.

The invention claimed is:

1. A method of designing an anti-counterfeiting article for an object comprising an identification code of the object, comprising:

creating a pseudo-random pattern of a basic element, wherein different locations on the pseudo-random pattern correspond to different values;

encoding the identification code of the object to determine a target location within the pseudo-random pattern having a value that corresponds to the encoded identification code;

assigning a color to the element at the target location; and assigning colors to the remaining elements in the pseudo-random pattern, wherein the color of the element at the target location is distinguishable over the colors of the remaining elements in the pseudo-random pattern to produce a HVS stimulus modulation texture, the texture providing camouflage for the element at the target location.

2. The method of claim 1, wherein colors for the texture are found by picking multiple colors that stimulate L and M cones of the human visual system so that only the ratios of the stimuli affecting the L and the M cones is varied, while S cone stimulation is kept constant; and wherein the color of element at the target location is found by varying the stimulation of the S cones of the human visual system while the sum of the L and M cone stimulations is kept constant.

3. The method of claim 1, wherein the identification code is a serial number of the object, said method further comprising:

using at least some of the digits in the serial number as a seed for a pseudo-random number generator; and using the pseudo-random number generator to create the pseudo-random pattern.

* * * * *